US011330679B2

(12) United States Patent
Fukumori et al.

(10) Patent No.: US 11,330,679 B2
(45) Date of Patent: May 10, 2022

(54) HEATING APPARATUS

(71) Applicant: SHARP KABUSHIKI KAISHA, Osaka (JP)

(72) Inventors: Atsutada Fukumori, Sakai (JP); Akio Iijima, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 305 days.

(21) Appl. No.: 16/821,732

(22) Filed: Mar. 17, 2020

(65) Prior Publication Data

US 2020/0305243 A1 Sep. 24, 2020

(30) Foreign Application Priority Data

Mar. 22, 2019 (JP) ..... JP2019-054220

(51) Int. Cl.

| | |
|---|---|
| ***H05B 6/68*** | (2006.01) |
| ***H05B 6/64*** | (2006.01) |
| ***F24C 15/02*** | (2006.01) |
| ***F24C 7/04*** | (2021.01) |
| ***H05B 6/66*** | (2006.01) |
| ***F24C 7/02*** | (2006.01) |

(52) U.S. Cl.

CPC ..... *H05B 6/6417* (2013.01); *F24C 7/02* (2013.01); *F24C 7/04* (2013.01); *F24C 15/02* (2013.01); *H05B 6/6441* (2013.01); *H05B 6/66* (2013.01)

(58) Field of Classification Search

CPC .. H05B 6/6405; H05B 6/6408; H05B 6/6411; H05B 6/6414; H05B 6/6417; H05B 6/6432; H05B 6/6435; H05B 6/6438; H05B 6/6441; H05B 6/6444; H05B 6/6447; F24C 7/02; F24C 7/04; F24C 7/087; F24C 15/02; F24C 15/022

USPC ..... 219/620, 625, 702, 722, 723, 724, 739

See application file for complete search history.

(56) References Cited

U.S. PATENT DOCUMENTS

| | | | | | |
|---|---|---|---|---|---|
| 3,214,567 | A | * | 10/1965 | Chisholm | G05D 23/1951 219/494 |
| 3,699,299 | A | * | 10/1972 | Umezu | H05B 6/6417 219/724 |
| 3,715,552 | A | * | 2/1973 | Umezu | H05B 6/6417 219/724 |
| 4,101,750 | A | * | 7/1978 | Doner | H05B 6/6417 219/724 |
| 4,862,870 | A | * | 9/1989 | Fox | F24C 14/02 126/197 |

(Continued)

FOREIGN PATENT DOCUMENTS

| | | | |
|---|---|---|---|
| CN | 1467434 | A | 1/2004 |
| CN | 108451341 | A | 8/2018 |

(Continued)

*Primary Examiner* — Hung D Nguyen

(74) *Attorney, Agent, or Firm* — ScienBiziP, P.C.

(57) ABSTRACT

A heating apparatus includes a heating circuit configured to heat a product to be heated; a door; a door lock mechanism configured to lock the door with the door closed; and a processor configured to control the heating circuit and the door lock mechanism, wherein based on an indication of a heating time period and a "settling" time period, the processor causes the door lock mechanism to lock the door, with the door closed, from a beginning of the heating until an end of the "settling" time period.

7 Claims, 6 Drawing Sheets

(56) References Cited

U.S. PATENT DOCUMENTS

| | | | | | |
|---|---|---|---|---|---|
| 4,899,034 | A * | 2/1990 | Kadwell | H05B 6/645 | 219/508 |
| 4,982,063 | A * | 1/1991 | Tsunekawa | F24C 15/022 | 219/724 |
| 5,293,020 | A * | 3/1994 | Han | G07C 9/00722 | 219/724 |
| 5,477,030 | A * | 12/1995 | Buckshaw | H05B 6/6417 | 219/724 |
| 5,517,006 | A * | 5/1996 | Fredriksson | F24C 15/022 | 219/724 |
| 2019/0234109 | A1 * | 8/2019 | Chen | F24C 15/022 | |

FOREIGN PATENT DOCUMENTS

| | | | |
|---|---|---|---|
| JP | 2004-198077 | A | 7/2004 |
| JP | 2005-188880 | A | 7/2005 |
| JP | 2008-096011 | A | 4/2008 |

* cited by examiner

FIG.3

32A

| PATTERN | HEATING TIME PERIOD | SETTLING TIME PERIOD |
|---|---|---|
| PATTERN 1 | 40 SEC. | 20 SEC. |
| PATTERN 2 | 60 SEC. | 30 SEC. |
| PATTERN 3 | 90 SEC. | 40 SEC. |
| PATTERN 4 | 120 SEC. | 50 SEC. |
| PATTERN 5 | 180 SEC. | 60 SEC. |
| PATTERN 6 | 300 SEC. | 90 SEC. |
| PATTERN 7 | 600 SEC. | 120 SEC. |

FIG.4

32B

| PRODUCT ID | PRODUCT | PATTERN |
|---|---|---|
| 012345 | AAA | PATTERN 3 |
| 012346 | BBB | PATTERN 5 |
| 012347 | CCC | PATTERN 2 |
| 012348 | DDD | PATTERN 1 |
| ⋮ | ⋮ | ⋮ |

HEATING APPARATUS

CROSS-REFERENCE TO RELATED APPLICATION

The present application claims priority from Japanese Application 2019-54220, the content to which is hereby incorporated by reference into this application.

BACKGROUND OF THE DISCLOSURE

Field of the Disclosure

The present disclosure relates to a heating apparatus which heats and defrosts such products as food products.

Description of the Background Art

A typical heating and cooking appliance to be used for heating and cooking to serve a product needs to be designed to ensure safety of a user, so that the user is kept from burning himself or herself when he or she takes the product at a high temperature out of the appliance immediately after the heating. As an example, a heating and cooking appliance is devised to lock the door when the temperature inside the appliance is higher than a certain temperature, thereby improving the safety of the appliance.

When such food products as frozen sushi and sweets are heated close to room temperature to be served, the products are often unevenly heated immediately after heating. An unevenly heated food product is likely to have a warm portion and a cold portion to be clearly distinctive. Such an unevenly heated portion deteriorates the quality of the product. Hence, it is not appropriate to serve the product immediately after heating, and the product needs to be left at room temperature for a certain time period (usually several to several dozen minutes) until the product whose temperature is unevenly distributed after heating has the temperature uniformly distributed.

For example, the heating and cooking appliances disclosed in Japanese Unexamined Patent Application Publication Nos. 2004-198077, 2005-188880, and 2008-096011 ensure safety by locking the door when the temperature inside the appliances is higher than a certain temperature. However, if heated is a product to be served near room temperature as described above, the door is unlocked immediately after the product has been heated. Accordingly, the user is inadvertently allowed to take the product out of the appliances before the unevenly distributed temperature of the product is uniformly distributed.

The present disclosure intends to provide a heating apparatus capable of reducing the risk of serving a product whose temperature is left unevenly distributed.

SUMMARY

An aspect of the present disclosure provides a heating apparatus including a heating circuit heating a product to be heated; a door; a door lock mechanism locking the door with the door closed; and a processor controlling the heating circuit and the door lock mechanism, wherein, based on an indication of a heating time period and a "settling" time period, the processor causes the door lock mechanism to lock the door, with the door closed, from a beginning of the heating until an end of the "settling" time period.

The present disclosure provides a heating apparatus capable of reducing the risk of serving a product whose temperature is left unevenly distributed.

BRIEF DESCRIPTION OF THE DRAWINGS

FIG. 3 illustrates a "settling" time period table according to a second embodiment:

FIG. 4 illustrates a product information table according to the second embodiment;

DESCRIPTION OF THE PREFERRED EMBODIMENTS

Figure 1:
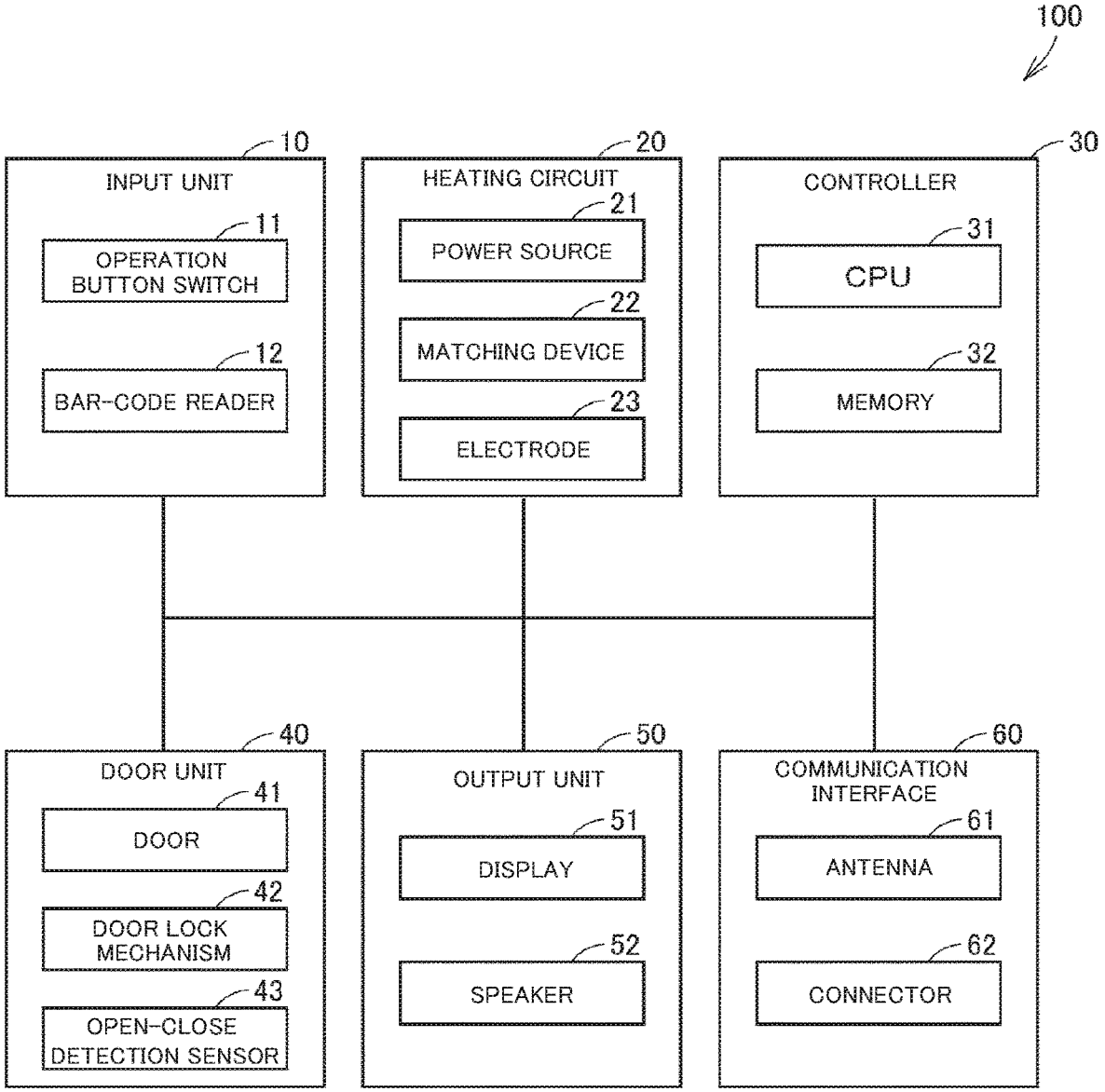
FIG. 1 illustrates a block diagram showing a configuration of a heating apparatus according to a first embodiment.

Described below are embodiments of the present disclosure with reference to the drawings. In the descriptions below, identical reference signs are used to denote identical components. The identical components share the same name and function. Hence, detailed descriptions of such components shall not be repeated.

First Embodiment (Configuration of High Frequency Defroster)

Described first is an overall configuration of a heating apparatus 100 according to a first embodiment. The heating apparatus 100 includes as main components: an input unit 10; a heating circuit 20; a controller 30; a door unit 40; an output unit 50; and a communication interface 60.

The input unit 10 includes such components as an operation button switch 11 and a bar-code reader 12. The operation button switch 11 receives commands to indicate a heating time period and a "settling" time period. The bar-code reader 12 reads a bar code provided to a label of a product to obtain information such as a heating time period, a power level, and a "settling" time period. Note that the "settling" time period is a waiting time period required until uneven temperature distribution of the heated product becomes less obvious.

The heating circuit 20, which includes: a power source 21; a matching device 22; and an electrode 23, outputs a microwave from the electrode 23 to heat and cook a product to be heated.

The controller 30 includes: a central processing unit (CPU) 31; and a memory 32. With reference to various kinds of data stored in the memory 32, the CPU 31 controls the components of the heating apparatus 100 in accordance with a control program stored in the memory 32. The components such as the power source 21 and the matching device 22 are included in the heating circuit 10.

The door unit 40 includes: a door 41; a door lock mechanism 42; and an open-close detection sensor 43. Based on an instruction from the controller 30, the door lock mechanism 42 locks the door 41 with the door 41 closed. The open-close detection sensor 43 detects whether the door 41 is open or closed, and transmits the detected state to the controller 30.

The output unit 50 includes: a display 51; and a speaker 52. The display 51 presents a text message and an image based on an instruction from the controller 30. Note that the operation button switch 11 and the display 51 may be included in a touch panel. The speaker 52 outputs audio based on an instruction from the controller 30.

Based on an instruction from the controller 30, the communication interface 60 transmits data to, and receives data from, another apparatus through Wi-Fi (Registered), the Internet, and a carrier network. Note that the communication interface 60 may include an antenna 61 for wireless communications and a connector 62 for wireline communications.

Figure 2:
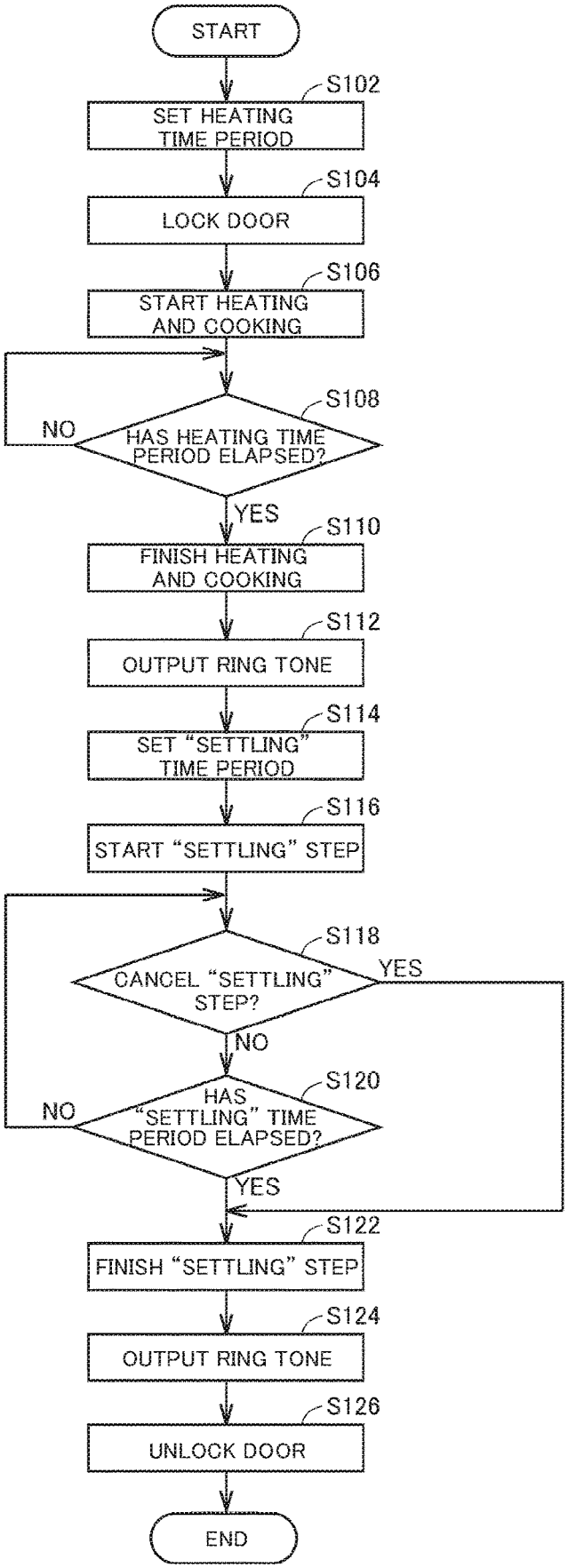
FIG. 2 illustrates a flowchart showing processing on the heating apparatus according to the first embodiment.

Described below is processing on the controller 30 according to this embodiment. Through the operation button switch 11 and the bar-code reader 12, the CPU 31 according to this embodiment receives instructions for a heating time period and a "settling" time period and a command to start cooking, and executes the processing illustrated in FIG. 2.

First, the CPU 31 sets a received heating time period (Step S102). The CPU 31 causes the door lock mechanism 42 to lock the door 41 with the door 41 closed (Step S104). The CPU 31 causes the heating circuit 20 to start heating and cooking (Step S106).

The CPU 31 determines whether the set heating time period has elapsed since the beginning of the heating and cooking (Step S108). If the heating time period has elapsed (Step S108: YES), the CPU 31 causes the heating circuit 20 to finish cooking and heating (Step S110), and notifies through the display 51 and the speaker 52 that the heating and cooking has ended (Step S112).

The CPU 31 sets a received "settling" time period (Step S114), and starts a "settling" step (Step S116). Through the operation button switch 11, the CPU 31 determines whether to have received a command to cancel the "settling" step (Step S118).

If receiving the command to cancel the "settling" step (Step S118: YES), the CPU 31 finishes the "settling" step (Step S122), and notifies through the display 51 and the speaker 52 that the "settling" time period has ended (Step S124). The CPU 31 causes the door lock mechanism 42 to unlock the door 41 (Step S126).

If not receiving the command to cancel the "settling" step (Step S118: NO), the CPU 31 determines whether the "settling" time period has elapsed (Step S120). If the "settling" time period has not elapsed (Step S120: NO), the CPU 31 repeats the processing from Step S118.

If the "settling" time period has elapsed (Step S120: YES), the CPU 31 executes processing from Step S122.

Hence, the heating apparatus 100 according to this embodiment is designed so that the user cannot take out the heated product unless the heated product is left at room temperature for a certain time period (i.e., the "settling" time period). Such a feature makes it possible to reduce the risk that a product whose temperature is unevenly distributed immediately after the heating is served before the temperature is uniformly distributed, contributing to an improvement in quality of the product.

Moreover, the heating apparatus 100 allows for setting of two kinds of time periods; namely, a heating time period and a "settling" time period. Such a feature makes it possible to prioritize safety and mandatorily lock the door during the heating time period, whereas, the feature allows the user to unlock the door at the user's discretion during the "settling" time period because there is no concern about safety during the "settling" time period. As a result, the heating apparatus 100 can improve the quality of the product while ensuring the safety.

Second Embodiment

In the above embodiment, the user inputs a heating time period and a "settling" time period through the controller. Alternatively, the bar-code reader is used to read a heating time period and a "settling" time period of a product to be heated. However, the features of the heating apparatus 100 shall not be limited to those in the first embodiment. An example of the features is to prepare multiple patterns of combinations between the heating time period and the "settling" time period.

For example, the memory 32 stores a "settling" time period table 32A illustrated in FIG. 3. The "settling" time period table 32A includes multiple patterns of combinations between a heating time period and a "settling" time period.

Then, the memory 32 stores a product information table 32B illustrated in FIG. 4. The product information table 32B includes a corresponding relationship between a kind of a product, a heating time period suitable to the product, and a "settling" time period pattern suitable to the product.

Figure 5:
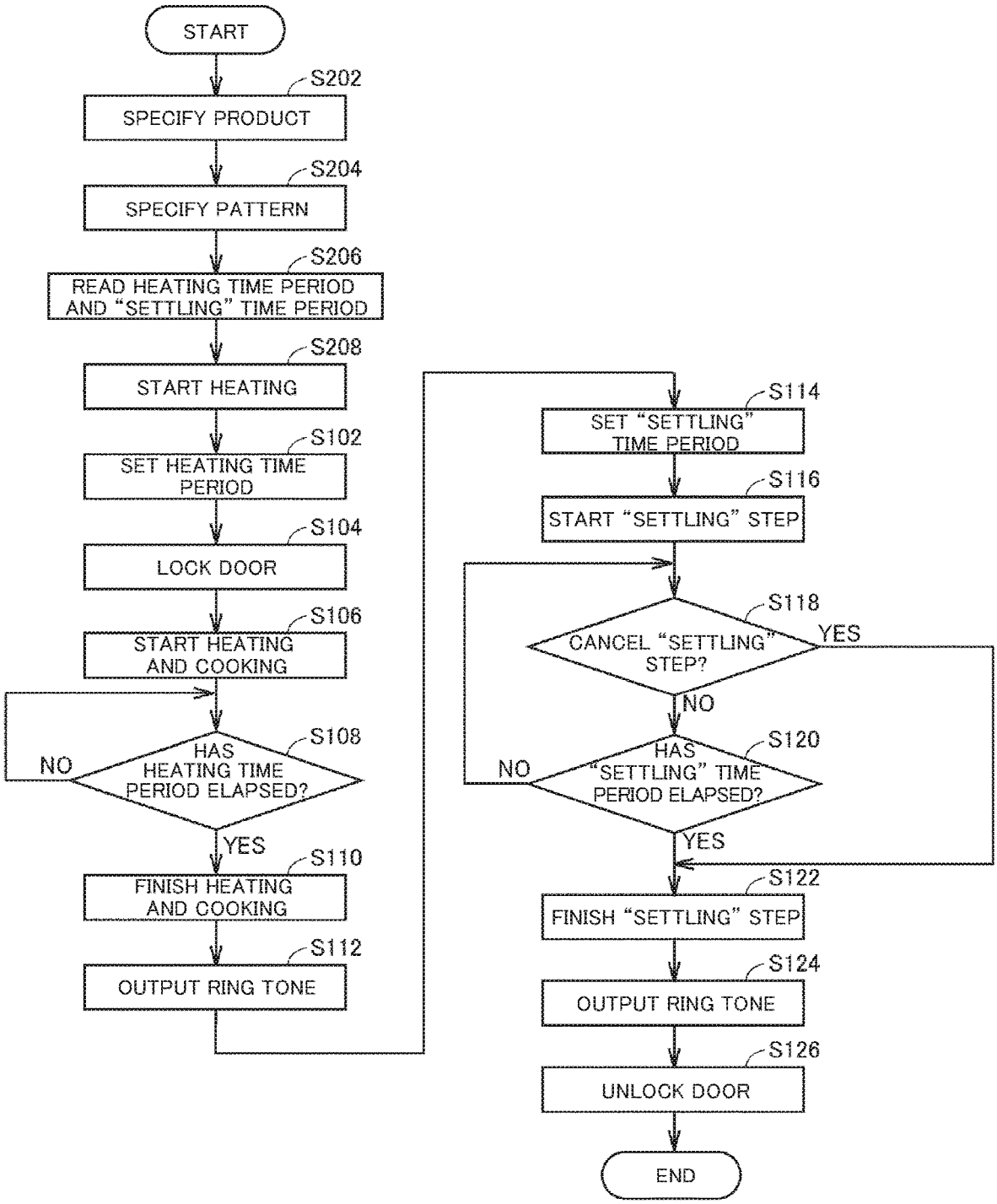
FIG. 5 illustrates a flowchart showing processing on the heating apparatus according to the second embodiment.

As illustrated in FIG. 5, through the operation button switch 11 and the bar-code reader 12 of the input unit 10, the CPU 31 in this embodiment first specifies what a product to be heated is like (Step S202). With reference to the product information table 32B, in the memory 32, based on the specified product, the CPU 31 specifies a pattern (Step S204). With reference to the "settling" time table 32A, in the memory 32, based on the specified pattern, the CPU 31 reads a heating time period and a "settling" time period (Step S206).

When receiving a command to start heating and cooking (Step S208), the CPU 31 sets the heating time period read from the "settling" time period table 32A (Step S102). The CPU 31 causes the door lock mechanism 42 to lock the door 41 with the door 41 closed (Step S104). The CPU 31 causes the heating circuit 20 to start heating and cooking (Step S106).

The CPU 31 determines whether the set heating time period has elapsed since the beginning of the heating and cooking (Step S108). If the heating time period has elapsed (Step S108: YES), the CPU 31 causes the heating circuit 20 to finish cooking and heating (Step S110), and notifies through the display 51 and the speaker 52 that the heating and cooking has ended (Step S112).

The CPU 31 sets the "settling" time period read from the "settling" time period table 32A (Step S114), and starts the "settling" step (Step S116). Through the operation button switch 11, the CPU 31 determines whether to have received a command to cancel the "settling" step (Step S118).

If receiving the command to cancel the "settling" step (Step S118: YES), the CPU 31 finishes the "settling" step (Step S122), and notifies through the display 51 and the speaker 52 that the "settling" time period has ended (Step S124). The CPU 31 causes the door lock mechanism 42 to unlock the door 41 (Step S126).

If not receiving the command to cancel the "settling" step (Step S118: NO), the CPU 31 determines whether the "settling" time period has elapsed (Step S120). If the "settling" time period has not elapsed (Step S120: NO), the CPU 31 repeats the processing from Step S118.

If the "settling" time period has elapsed (Step S120: YES), the CPU 31 executes processing from Step S122.

Third Embodiment

In addition to the configurations of the above embodiments, a third embodiment further involves displaying (i) the "settling" step in progress until the "settling" time period elapses and (ii) a time period remaining until the end of the "settling."

Figure 6:
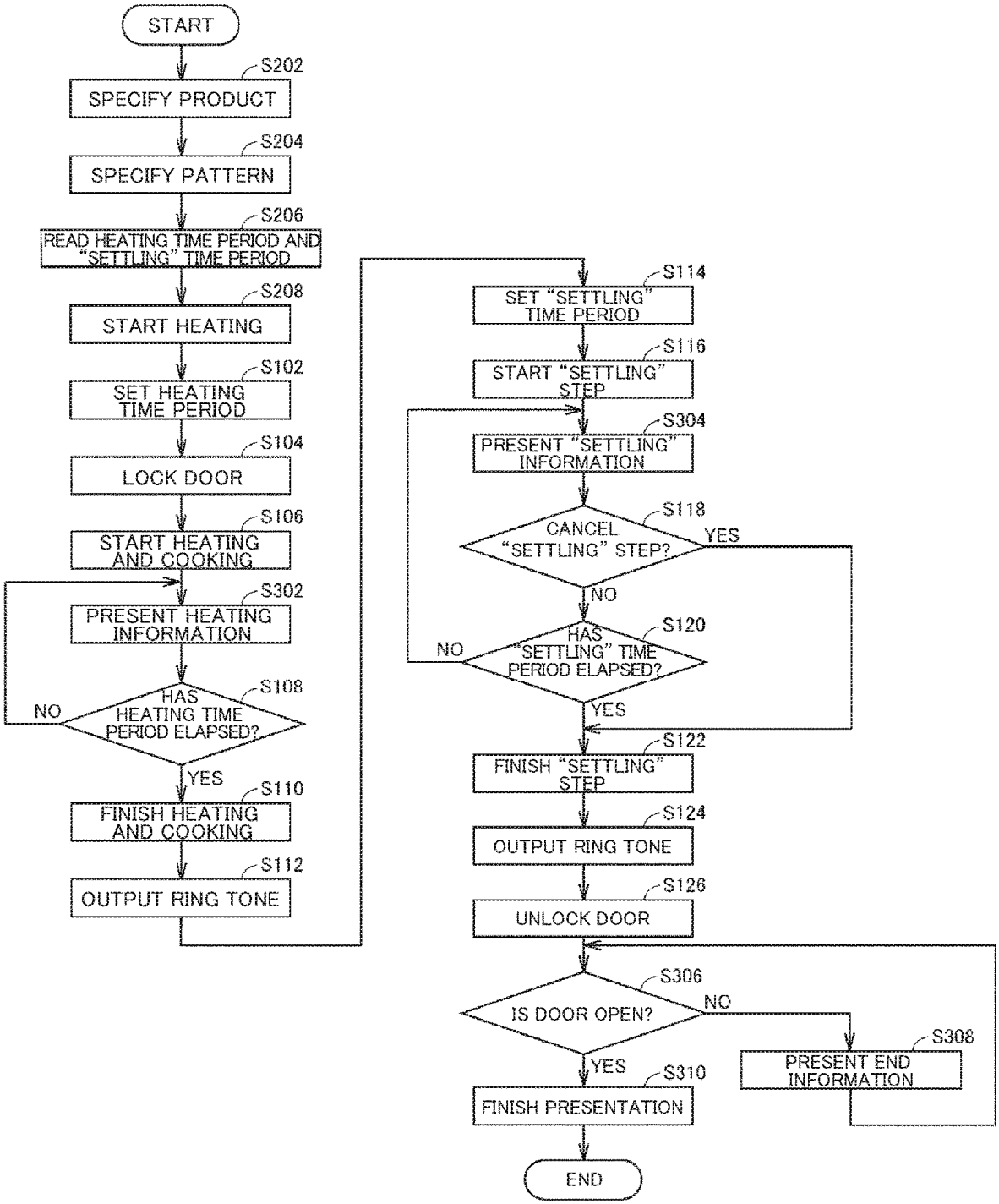
FIG. 6 illustrates a flowchart showing processing on the heating apparatus according to a third embodiment.

More specifically, as illustrated in FIG. 6, through the operation button switch 11 and the bar-code reader 12 included in the input unit 10, the CPU 31 in this embodiment specifies what a product to be heated is like (Step S202). With reference to the product information table 32B, in the memory 32, based on the specified product, the CPU 31 specifies a pattern (Step S204). With reference to the "settling" time table 32A, in the memory 32, based on the specified pattern, the CPU 31 reads a heating time period and a "settling" time period (Step S206).

When receiving a command to start heating and cooking (Step S208), the CPU 31 sets the heating time period read from the "settling" time period table 32A (Step S102). The CPU 31 causes the door lock mechanism 42 to lock the door 41 with the door 41 closed (Step S104). The CPU 31 causes the heating circuit 20 to start heating and cooking (Step S106).

Particularly in this embodiment, the CPU 31 causes the display 51 to present the heating and cooking currently in progress, and to present a time period remaining until the end of the heating and cooking (Step S302).

The CPU 31 determines whether the set heating time period has elapsed since the beginning of the heating and cooking (Step S108). If the heating time period has elapsed (Step S108: YES), the CPU 31 causes the heating circuit 20 to finish cooking and heating (Step S110), and notifies through the display 51 and the speaker 52 that the heating and cooking has ended (Step S112).

Next, the CPU 31 sets the "settling" time period read from the "settling" time period table 32A (Step S114), and starts the "settling" step (Step S116).

Particularly in this embodiment, the CPU 31 causes the display 51 to present the "settling" step currently in progress, and to present a time period remaining until the end of the "settling" time period (Step S304).

Note that, in Step S304, the CPU 31 may cause the speaker 52 to present, along with or instead of the presentation on the display 51, a message and a ring tone notifying that the "settling" step is currently in progress. Moreover, the CPU 31 may cause the speaker 52 to present, along with or instead of the presentation on the display 51, the time period remaining until the end of the "settling" time period.

Through the operation button switch 11, the CPU 31 determines whether to have received a command to cancel the "settling" step (Step S118).

If receiving the command to cancel the "settling" step (Step S118: YES), the CPU 31 finishes the "settling" step (Step S122), and notifies through the display 51 and the speaker 52 that the "settling" time period has ended (Step S124). The CPU 31 causes the door lock mechanism 42 to unlock the door 41 (Step S126).

If not receiving the command to cancel the "settling" step (Step S118: NO), the CPU 31 determines whether the "settling" time period has elapsed (Step S120). If the "settling" time period has not elapsed (Step S120: NO), the CPU 31 repeats the processing from Step S304.

If the "settling" time period has elapsed (Step S120: YES), the CPU 31 executes processing from Step S122.

Particularly in this embodiment, after the door is unlocked (Step S126) until the door 41 is open (Step S306: YES), the CPU 31 causes, based on a signal from the open-close detection sensor 43, the display 51 to present a text message and an image notifying that the "settling" time period has ended (Step S308), encouraging the user to open the door 41. Note that the CPU 31 may cause the speaker 52 to present, along with or instead of the presentation on the display 51, a message and a ring tone notifying that the "settling" time period has ended.

Fourth Embodiment

In addition to the configurations of the above embodiments, a fourth embodiment further involves periodically transmitting to another apparatus information indicating (i) the "settling" step in progress until the "settling" time period elapses and (ii) a time period remaining until the end of the "settling."

Figure 7:
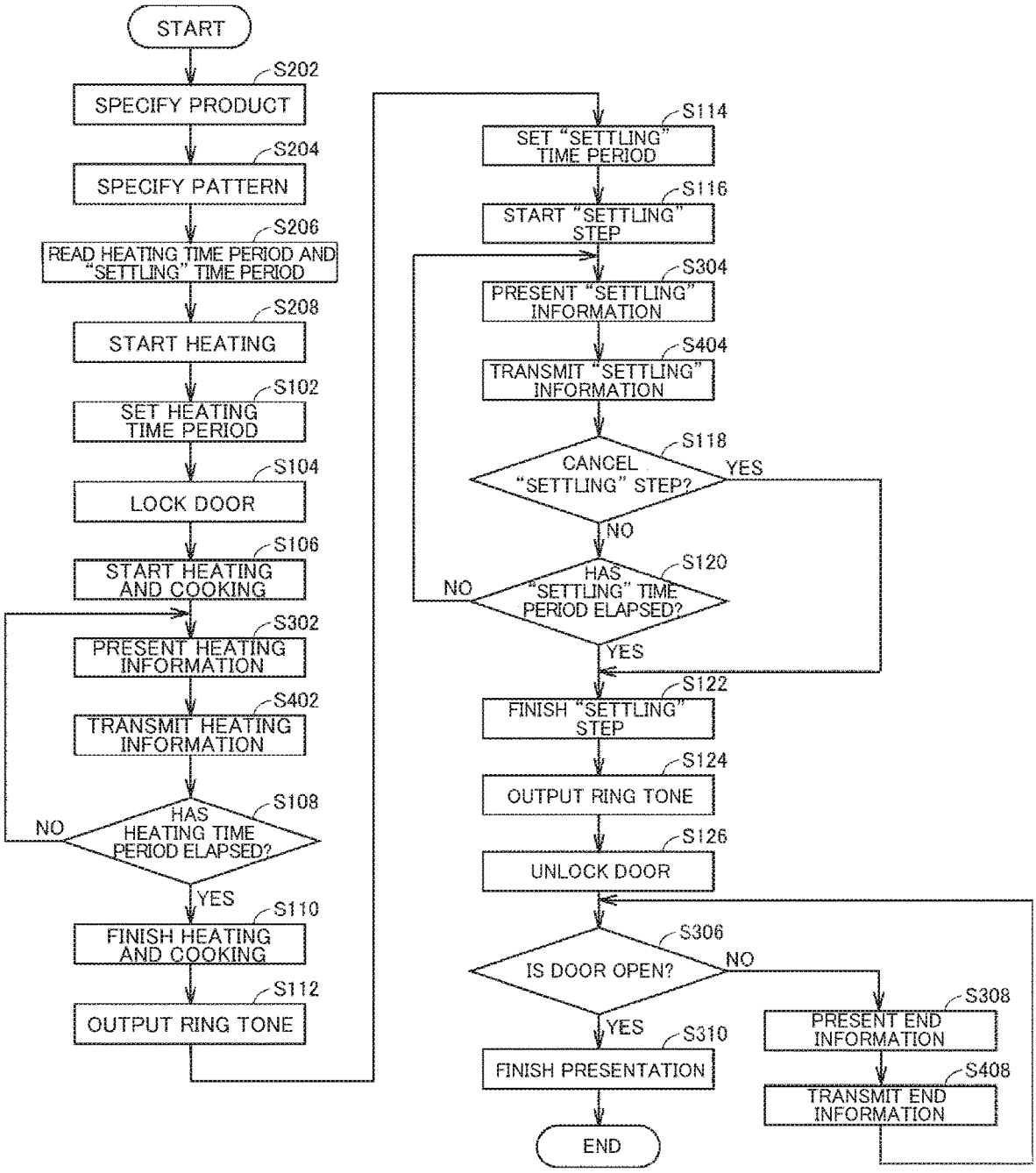
FIG. 7 illustrates a flowchart showing processing on the heating apparatus according to a fourth embodiment.

More specifically, as illustrated in FIG. 7, the CPU 31 transmits through the communication interface 60 information to other pre-registered terminals such as a smartphone, a wearable terminal, and a speaker, the information including (i) information indicating the "settling" step currently in progress and (ii) information indicating a time period remaining until the end of the "settling" time period (Step S404).

Furthermore, the CPU 31 may transmit through the communication interface 60 information to other pre-registered terminals such as a smartphone, a wearable terminal, and a speaker, the information including (i) information indicating the heating and cooking currently in progress and (ii) information indicating a time period remaining until the end of the heating and cooking (Step S402).

Moreover, the CPU 31 may transmit through the communication interface 60 information to other pre-registered terminals such as a smartphone, a wearable terminal, and a speaker, the information indicating that the "settling" time period has ended (Step S408).

Fifth Embodiment

In the above embodiments, the heating circuit 20 includes the power source 21, the matching device 22, and the electrode 23. Instead of utilizing a technique to heat with a microwave, the heating circuit 20 may utilize another technique to heat and cook with, for example, a heating wire.

<Summary>

Provided in the above embodiments is a heating apparatus including: a heating circuit heating a product to be heated; a door; a door lock mechanism locking the door with the door closed; and a processor controlling the heating circuit and the door lock mechanism. Based on an indication of a heating time period and a "settling" time period, the processor causes the door lock mechanism to lock the door, with the door closed, from a beginning of the heating until an end of the "settling" time period.

Preferably, the heating apparatus may further include a bar-code reader reading information from a label attached to the product, the information indicating the "settling" time period.

Preferably, the heating apparatus may further include an input unit receiving an input of information for indicating a combination included in the plurality of combinations.

Preferably, the heating apparatus may further include: a sensor configured to detect whether the door is open or closed; and a display. The processor may cause the display to present that the "settling" time period has not ended until the end of "settling" time period, and that the "settling" time period has ended until the door is open after the end of the "settling" time period.

Preferably, the processor may cause the door lock mechanism to unlock the door when receiving a predetermined operation even before the end of the "settling" time period.

Preferably, the heating apparatus may further include a communication interface. From the beginning of the heating until the end of the "settling" time period, the processor may cause the communication interface to transmit information including at least one of: a time period remaining until an end of the heating; and a time period remaining until the end of the "settling" time period.

Preferably, the heating circuit may include: a power source; a matching circuit; and an electrode. The heating circuit may utilize dielectric heating.

The embodiments disclosed herein are examples in every respect, and not limiting of the present disclosure. The scope of the present disclosure is defined not by the descriptions above but by the scope of claims, and is intended to include all the modifications within the scope of the claims along with the their full scope of equivalents.

What is claimed is:

1. A heating apparatus comprising:

a heating circuit configured to heat a product to be heated;

a door;

a door lock mechanism configured to lock the door with the door closed; and a processor configured to control the heating circuit and the door lock mechanism, wherein based on an indication of a heating time period and a "settling" time period, the processor causes the door lock mechanism to lock the door, with the door closed, from a beginning of the heating until an end of the "settling" time period.

2. The heating apparatus according to claim 1 further comprising a bar-code reader configured to read information from a label attached to the product, the information indicating the "settling" time period.

3. The heating apparatus according to claim 1 further comprising:

a memory configured to store a plurality of combinations of the heating time period and the "settling" time period; and an input unit configured to receive an input of information for indicating a combination included in the plurality of combinations.

4. The heating apparatus according to claim 1 further comprising:

a sensor configured to detect whether the door is open or closed; and a display, wherein the processor causes the display to present that the "settling" time period has not ended until the end of "settling" time period, and that the "settling" time period has ended until the door is open after the end of the "settling" time period.

5. The heating apparatus according to claim 1, wherein the processor causes the door lock mechanism to unlock the door when receiving a predetermined operation even before the end of the "settling" time period.

6. The heating apparatus according to claim 1 further comprising a communication interface, wherein from the beginning of the heating until the end of the "settling" time period, the processor causes the communication interface to transmit information including at least one of: a time period remaining until an end of the heating; and a time period remaining until the end of the "settling" time period.

7. The heating apparatus according to claim 1, wherein the heating circuit includes: a power source; a matching circuit; and an electrode, and the heating circuit utilizes dielectric heating.

* * * * *